United States Patent [19]

Miller et al.

[11] Patent Number: 5,067,238

[45] Date of Patent: Nov. 26, 1991

[54] SHAVING SYSTEM

[75] Inventors: Gary R. Miller, Tewksbury; Frederick R. Borden, Brockton; Robert A. Trotta, Pembroke, all of Mass.

[73] Assignee: The Gillette Company, Boston, Mass.

[21] Appl. No.: 589,998

[22] Filed: Sep. 28, 1990

[51] Int. Cl.[5] ..... B26B 19/42; B26B 21/22

[52] U.S. Cl. ..... 30/34.002; 30/50

[58] Field of Search ..... 30/34.2, 50

[56] References Cited

U.S. PATENT DOCUMENTS

| | | | |
|---|---|---|---|
| D. 290,050 | 5/1987 | Jacobson | D28/47 |
| 2,814,104 | 11/1957 | Miller | 30/34.2 |
| 3,138,865 | 6/1964 | Meyer | 30/34.2 |
| 3,500,539 | 3/1970 | Muros | 30/40.1 |
| 3,768,161 | 10/1973 | Miller | 30/41 |
| 4,044,463 | 8/1977 | Tietjens | 30/34.2 |
| 4,498,235 | 2/1985 | Jacobson | 30/47 |
| 4,586,255 | 5/1986 | Jacobson | 30/41 |
| 4,621,424 | 11/1986 | Jacobson | 30/41 |
| 4,914,817 | 4/1990 | Galligan | 30/77 |

*Primary Examiner*—Mark Rosenbaum
*Assistant Examiner*—Kenneth E. Peterson
*Attorney, Agent, or Firm*—Fish & Richardson

[57] ABSTRACT

A shaving system of the wet shave type includes body structure that incorporates guide structure and fixed skin-engaging structure with skin-tensioning surface structure. Blade structure, carried by the body structure rearwardly of the fixed skin-engaging structure, has a cutting edge extending along the length of the body structure, and movable guard structure is carried by the body structure between and adjacent to the fixed skin-engaging structure and the cutting edge of the blade structure. The movable guard structure includes a series of skin-tensioning crest portions disposed for skin-engagement between and adjacent to the fixed skin-engaging structure and the cutting edge. The movable guard structure is positioned in the body structure in engagement with biasing structure for dynamic movement of the movable guard structure relative to the fixed skin-engaging structure against the biasing structure as guided by the guide structure in the course of shaving.

15 Claims, 2 Drawing Sheets

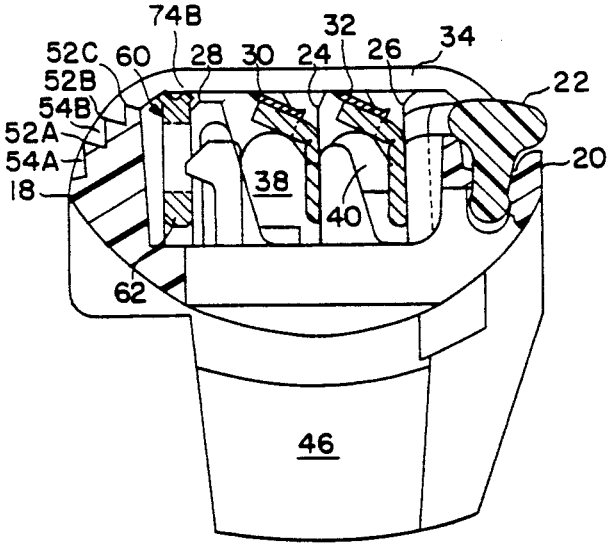
FIG. 4
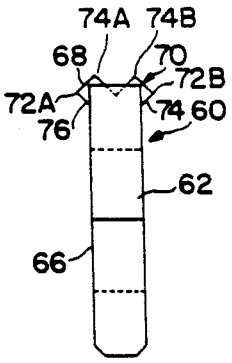
FIG. 5
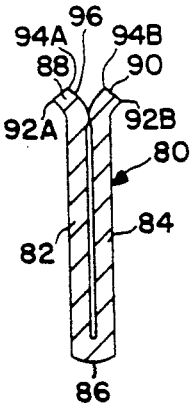
FIG. 8
FIG. 6
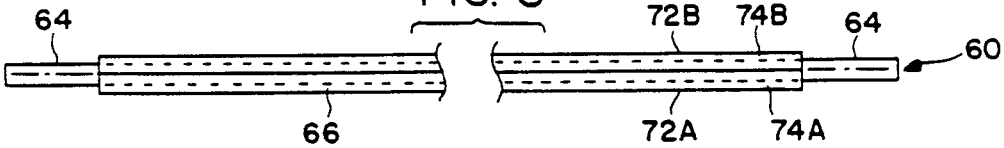
FIG. 7
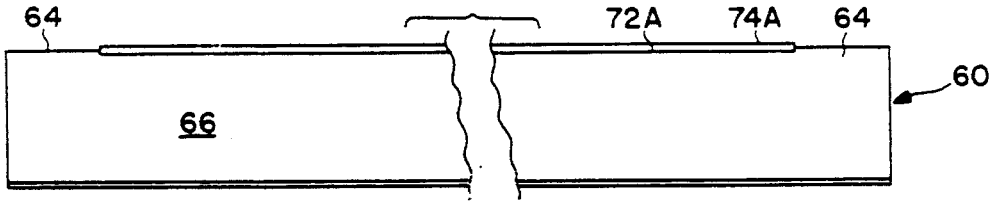
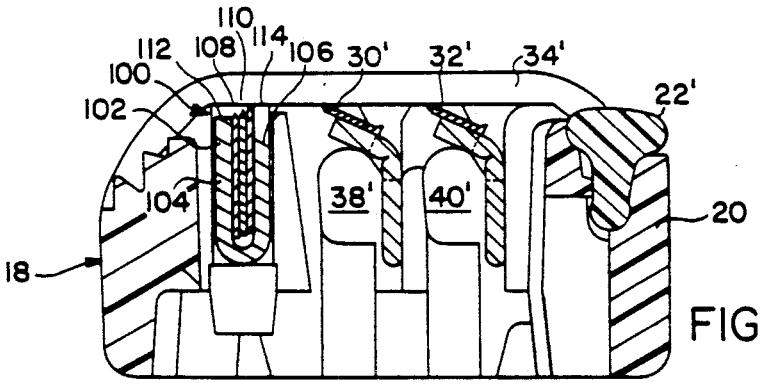
FIG. 9

SHAVING SYSTEM

This invention relates to shaving systems, and more particularly to shaving systems of the wet shave type.

A shaving system of the wet shave type includes at least one blade structure and a surface for engaging the user's skin adjacent the blade edge or edges. Typically, the shaving system includes a leading skin-engaging surface (forward of the cutting edge of the blade structure) and a trailing skin-engaging surface (rearwardly of the blade unit structure). The leading skin-engaging surface may be referred to as a guard surface and the trailing skin-engaging surface may be referred to as a cap surface. The skin-engaging surface(s) cooperates with the blade edge or edges and has one or more functions such as definition of shaving geometry, tensioning of skin in the region to be shaved, and/or delivery of shaving aid material to the skin surface during the shaving stroke. The shaving system may be of the disposable cartridge type adapted for coupling to and uncoupling from a razor handle or may be integral with a handle so that the complete razor is discarded as a unit when the blade or blades become dulled.

In accordance with one aspect of the invention, there is provided a shaving system of the wet shave type that includes body structure that incorporates guide structure and fixed skin-engaging structure with skin-tensioning surface structure. Blade structure, carried by the body structure rearwardly of the fixed skin-engaging structure, has a cutting edge extending along the length of the body structure, and movable guard structure is carried by the body structure between and adjacent to the fixed skin-engaging structure and the cutting edge of the blade structure. The movable guard structure includes a series of skin-tensioning crest portions disposed for skin-engagement between and adjacent to the fixed skin-engaging structure and the cutting edge. The movable guard structure is positioned in the body structure in engagement with biasing structure for dynamic movement of the movable guard structure relative to the fixed skin-engaging structure against the biasing structure as guided by the guide structure in the course of shaving.

In preferred embodiments, the movable guard structure includes a metal member with integral tab portions that are received in opposed slots in the body structure for guiding movement of the metal guard member along a predetermined straight-line path relative to the body structure; the skin tensioning surface structure of the fixed skin-engaging structure includes a plurality of crest structures with radii of curvature less than 0.1 millimeter; and the crest portions on the movable guard structure also have radii of curvature less than 0.1 millimeter.

In particular embodiments, the shaving system includes two blade structures that are mounted on the body structure for resilient movement with respect to each other and to the body structure; and the movable guard structure includes a metal body portion and at least two transversely extending crest portions that are spaced less than one millimeter apart. In one embodiment, the metal body portion and the crest portions are parts of a single integral member, and in another embodiment, the metal body portion is a U-shaped carrier member and a plurality of metal strips with sharpened edges are secured in the carrier member. The fixed skin-tensioning surface structure includes three ridges with crests that have radii of curvature less than 0.1 millimeter and are spaced at least about 0.2 millimeter apart, with the series of crests extending along a path that is about 45° to the shaving plane defined by the sharpened edges of the two blade units.

Other features and advantages will be seen as the following description of particular embodiments progresses in conjunction with the drawings in which:

FIG. 4 is a sectional view of the shaving system assembly of FIG. 1 taken along the line 4—4 of FIG. 2;

FIG. 5 is a side elevational view of a movable guard structure incorporated in the shaving system of FIG. 1;

FIG. 6 is a top plan view of the guard structure of FIG. 5;

FIG. 7 is a front elevational view of the guard structure taken along the line 7—7 of FIG. 5;

FIG. 8 is a side elevational view, similar to FIG. 5 of an alternate movable guard structure, and FIG. 9 is a sectional view, similar to FIG. 4, of an alternate shaving system assembly.

DESCRIPTION OF PARTICULAR EMBODIMENTS

Figure 1:
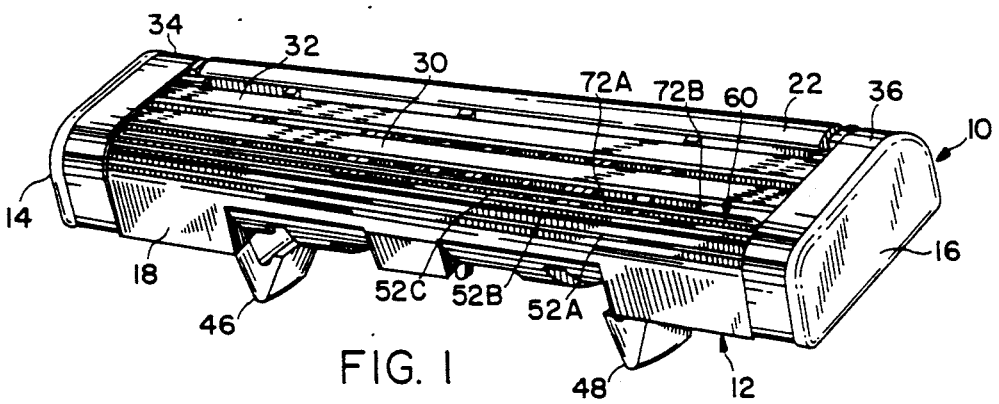
FIG. 1 is a perspective view of a shaving system in accordance with the invention.
Figure 2:
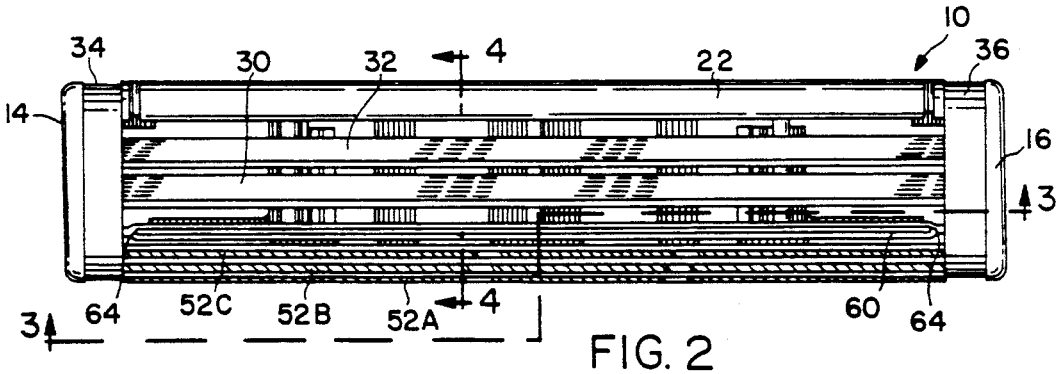
FIG. 2 is a plan view, with parts broken away, of the shaving system of FIG. 1.
Figure 3:
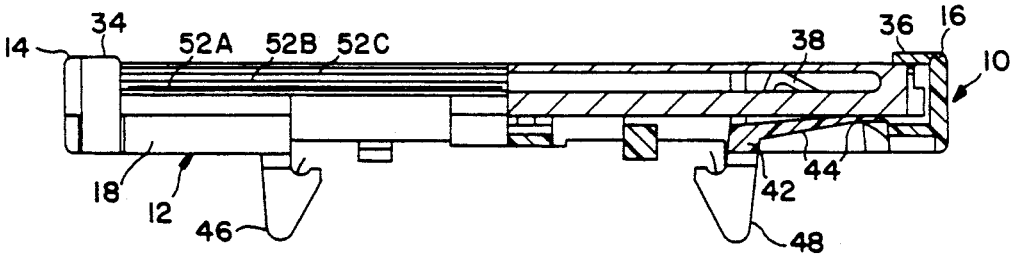
FIG. 3 is an elevational view taken along the line 3—3 of FIG. 2.

The razor blade assembly 10 shown in FIGS. 1–4 is of the type shown in Jacobson U.S. Pat. Nos. 4,498,235 and 4,586,255 (the disclosures of which are expressly incorporated herein by reference) and includes body member 12 of molded polymeric material that has end portions 14, 16 interconnecting front and rear portions 18, 20 and intermediate frame portions. Insert member 22 of shaving aid material, carried by rear portion 20, is made of a mixture of water insoluble polymeric matrix material (polystyrene) and water-leachable shaving aid material (polyethylene oxide).

Each end portion 14, 16 has opposed slots 24, 26, 28 and carries biasing spring fingers 38, 40. Slots 24 receive slide portions of leading blade unit 30 and slots 26 receive slide portions of trailing blade unit 32. Each blade unit 30, 32 is biased upwardly against metal retaining bands 34, 36 by spring fingers 38, 40 respectively. Body member 12 also includes frame portions 42 that are provided with biasing spring fingers 44. Assembly 10 also includes depending extensions 46, 48, each of which includes an arcuate guide rail surface that engages in pivotal attachment to a razor handle (not shown).

Formed on portion 18 is a fixed skin-tensioning surface structure disposed for skin-engagement. The skin-tensioning surface structure includes three ridges with crests 52 that have radii of curvature less than 0.1 millimeter defined by surfaces that are disposed at angles of 75° to one another, each ridge having vertical surface 54 in front of its crest. Crest 52A is spaced about 0.4 millimeter from crest 52B, crest 52C is spaced about 0.2 millimeter from crest 52B, and the series of crests 52 extends along a path that is about 45° to the shaving plane defined by the sharpened edges of blade units 30, 32.

Disposed in the region between front portion 18 and leading blade unit 30 is movable guard member 60 that includes vertical body portion 62 with guide portions 64 at either end that are received in guide slots 28 of end portions 14, 16 so that the front surface 66 of body 62 is about 0.6 millimeter rearwardly of crest 52C. Movable guard member 60 is a 0.45 millimeter thick aluminum plate, and has die-formed diverging portions 68, 70 with crests 72A, 72B spaced about 0.7 millimeter apart and crests 74A, 74B spaced about 0.4 millimeter apart. Each crest 72, 74 has a radius of about 0.03 millimeter. Each diverging surface 76 make an angle of about 135 degrees with the adjacent vertical wall of body 62. Crests 74 are located about 0.05 millimeter above the shaving plane defined by the cutting edges of blade units 30, 32 structure when movable guard 60 is in its uppermost position to provide desired tensioning of the skin surface.

In assembly, the guide portions 64 of movable guard member 60 are positioned in slots 28 of body member 10, and biased upwardly against retaining bands 34, 36 by biasing fingers 44. Blade units 30 and 32 are similarly received in slots 24, 26 in end portions 14, 16 as indicated in FIGS. 1–4.

The resulting blade assembly is attached to a handle for shaving and the guard member 60 and blade units 30 and 32 move along predetermined sliding paths in their respective slots independently of each other against the bias of the spring fingers during shaving. Concurrently, the blade assembly as a whole pivots on the handle, following the contours of the skin surface being shaved. Friction enhancing ridge crests 52 and 72 cooperate to dynamically tension the skin during the shaving performed by blade units 30, 32, and shaving aid materials are concurrently transferred from member 22 for deposit on the skin surface being shaved.

An alternate movable guard member 80 is of 0.2 millimeter thick aluminum sheet is shown in FIG. 8, and has parallel abutting body portions 82, 84 joined at their bases by integral coupling portion 86. Each body portion 82, 84 has a diverging portion 88, 90 at its upper end that provides crests 92A, 92B spaced about 0.7 millimeter apart and crests 94A, 94B spaced about 0.4 millimeter apart. Each crest 92, 94 has a radius of about 0.01 millimeter. Each diverging surface 96 make an angle of about 135 degrees with the adjacent vertical wall of its body portion 82, 84. Crests 94 are located about 0.05 millimeter above the shaving plane defined by the cutting edges of blade units 30', 32' when movable guard 80 is in its uppermost position to provide desired skin tensioning.

In assembly, the guide portions 64' of movable guard member 80 are positioned in slots 28' of body member 10', and biased upwardly against retaining bands by biasing fingers. Blade units are similarly received in slots in end portions as indicated in FIGS. 1–4.

The resulting blade assembly is attached to a handle for shaving and the guard member 80 and blade units move along predetermined sliding paths in their respective slots independently of each other against the bias of the spring fingers during shaving. Concurrently, the blade assembly as a whole pivots on the handle, following the contours of the skin surface being shaved. Friction enhancing ridge crests 92 and 94 cooperate with fixed ridges to dynamically tension the skin during the shaving performed by the blade units, and shaving aid material is concurrently transferred for deposit on the skin surface being shaved.

Another embodiment is shown in FIG. 9. In that embodiment, movable guard assembly 100 is substituted for the movable guard member 60 of the embodiment shown in FIGS. 1–7. Movable guard assembly 100 includes U-shaped sheet metal carrier member 102 that has forward vertical portion 104 spaced from rear vertical portion 106. Three metal blades 108, each of about 0.1 millimeter thickness with a crest edge 110 of about 0.02 millimeter radius, are secured in stacked relation between portions 104, 106. Crest edges 110 of blades 108 are vertically offset (about 0.1 millimeter) as are the top surfaces 112, 114 of U-shaped carrier member 102 and provide skin-tensioning surfaces. Operation of the FIG. 9 embodiment is similar to that of the FIGS. 1–7 embodiment.

While particular embodiments of the invention have been shown and described, various modifications may be apparent to those skilled in the art, and therefore it is not intended that the invention be limited to the disclosed embodiments or to details thereof, and departures may be made therefrom within the spirit and scope of the claims.

What is claimed is:

1. A shaving system comprising body structure that incorporates guide structure, and fixed skin-engaging structure that has skin-tensioning surface structure thereon, blade structure carried by said body structure rearwardly of said fixed skin-engaging structure, said blade structure having a cutting edge extending along the length of said body structure, movable guard structure carried by said body structure between and adjacent to said fixed skin-engaging structure and said cutting edge of said blade structure, said movable guard structure including two parallel body portions, each said body portion extending separately parallel to said cutting edge and having an integral diverging portion at its upper end that defines a crest portion, each said crest portion having a radius of curvature of about 0.02 millimeter, said crest portions being spaced less than one millimeter apart and being disposed for skin-engagement between and adjacent to said fixed skin-engaging structure and said cutting edge, and biasing structure, said movable guard structure being positioned in said body structure in engagement with said biasing structure for dynamic movement of said movable guard structure against said biasing structure as guided by said guide structure in the course of shaving.

2. The shaving system of claim 1 wherein said movable guard structure includes integral tab portions, and said guide structure in said body structure includes opposed slots in which said tab portions are disposed for guiding movement of said movable guard structure along a predetermined path relative to said body structure.

3. The shaving system of claim 1 wherein said skin tensioning surface structure of said fixed skin-engaging structure includes crest structure with radii of curvature less than 0.1 millimeter.

4. The shaving system of claim 3 wherein there are a plurality of said crest structures on said fixed skin-engaging structure.

5. The shaving system of claim 1 wherein said biasing structure comprises resilient fingers integral with said body structure.

6. The shaving system of claim 1 wherein said blade structure is mounted for resilient movement with respect to said body structure.

7. The shaving system of claim 6 and further including second blade structure mounted on said body structure for resilient movement with respect to said body structure.

8. The shaving system of claim 1 and further including shaving aid material carried by said body structure on the other side of said blade structure from said movable guard structure.

9. The shaving system of claim 8 wherein said blade structure includes first and second blade units mounted on said body structure for independent resilient movement with respect to said body structure, said movable guard structure is positioned about two millimeters rearwardly of the front surface of said body structure, the cutting edge of said first blade unit is positioned about three millimeters rearwardly of said front surface; the cutting edge of said second blade unit is positioned about four millimeters rearwardly of said front surface; and the leading edge of said shaving aid member is positioned about six millimeters rearwardly of said front surface.

10. The shaving system of claim 9 wherein said skin tensioning surface structure of said fixed skin-engaging structure includes a plurality of fixed crest portions that are spaced at least 0.2 millimeter apart and have radii of curvature of about 0.01 millimeter.

11. The shaving system of claim 10 wherein said movable guard structure includes integral tab portions, and said guide structure in said body structure includes opposed slots in which said tab portions are disposed for guiding movement of said movable guard structure along a predetermined path relative to said body structure.

12. A shaving system comprising body structure that incorporates guide structure, and fixed skin-engaging structure that has skin-tensioning surface structure thereon;

blade structure carried by said body structure rearwardly of said fixed skin-engaging structure, said blade structure having a cutting edge extending along the length of said body structure, movable guard structure carried by said body structure between and adjacent to said fixed skin-engaging structure and said cutting edge of said blade structure, said movable guard structure including a U-shaped carrier member and at least two metal strips that have crest portions extending parallel to said cutting edge and spaced less than one millimeter apart and that are secured in said carrier member, said crest portions being disposed for skin-engagement between and adjacent to said fixed skin-engaging structure and said cutting edge and having radii of curvature of about 0.01 millimeter, said movable guard structure further including integral tab portions, said guide structure in said body structure including opposed slots in which said tab portions are disposed for guiding movement of said movable guard structure along a predetermined path relative to said body structure;

a shaving aid member carried by said body structure on the other side of said blade structure from said movable guard structure;

said movable guard structure being positioned about two millimeters rearwardly of the front surface of said body structure, the cutting edge of said blade structure being positioned about three millimeters rearwardly of said front surface; and the leading edge of said shaving aid member being positioned about said millimeters rearwardly of said front surface; and biasing structure, said movable guard structure being positioned in said body structure in engagement with said biasing structure for dynamic movement of said movable guard structure against said biasing structure as guided by said guide structure in the course of shaving.

13. A shaving system comprising body structure that incorporates guide structure, and fixed skin-engaging structure that has skin-tensioning surface structure thereon, blade structure carried by said body structure rearwardly of said fixed skin-engaging structure, said blade structure having a cutting edge extending along the length of said body structure, movable guard structure carried by said body structure between and adjacent to said fixed skin-engaging structure and said cutting edge of said blade structure, said movable guard structure including a U-shaped carrier member and at least two metal strips that have crest portions extending parallel to said cutting edge and spaced less than one millimeter apart and that are secured in said carrier member, said crest portions being disposed for skin-engagement between and adjacent to said fixed skin-engaging structure and said cutting edge, and biasing structure, said movable guard structure being positioned in said body structure in engagement with said biasing structure for dynamic movement of said movable guard structure against said biasing structure as guided by said guide structure in the course of shaving.

14. The shaving system of claim 13 wherein said blade structure includes first and second blade units mounted on said body structure for independent resilient movement with respect to said body structure.

15. The shaving system of claim 14 and further including a shaving aid member carried by said body structure on the other side of said blade structure from said movable guard structure.

* * * * *